US008814066B2

(12) United States Patent
Hung

(10) Patent No.: US 8,814,066 B2
(45) Date of Patent: Aug. 26, 2014

(54) GRIP STRUCTURE OF WATER SPRAYER

(75) Inventor: Chen-Fu Hung, Changhua County (TW)

(73) Assignee: Ryeh Ryh Enterprise Co. Ltd., Changhua (TW)

( * ) Notice: Subject to any disclaimer, the term of this patent is extended or adjusted under 35 U.S.C. 154(b) by 431 days.

(21) Appl. No.: 13/240,724

(22) Filed: Sep. 22, 2011

(65) Prior Publication Data

US 2013/0075497 A1 Mar. 28, 2013

(51) Int. Cl.
*B05B 7/02* (2006.01)

(52) U.S. Cl.
USPC ..... 239/525; 239/526

(58) Field of Classification Search
CPC ..... B05B 7/02
USPC ..... 239/525, 526, 530
See application file for complete search history.

(56) References Cited

U.S. PATENT DOCUMENTS

| | | | | |
|---|---|---|---|---|
| 4,986,477 | A * | 1/1991 | Roman | 239/455 |
| 6,264,121 | B1 * | 7/2001 | McClary | 239/525 |
| 6,502,768 | B2 * | 1/2003 | Chang | 239/526 |
| 6,698,671 | B1 * | 3/2004 | Chen | 239/525 |
| 7,226,002 | B2 * | 6/2007 | Luo | 239/526 |
| 7,789,326 | B2 * | 9/2010 | Luettgen et al. | 239/447 |

* cited by examiner

*Primary Examiner* — Davis Hwu
(74) *Attorney, Agent, or Firm* — Che-Yang Chen; Law Office of Michael Chen

(57) ABSTRACT

A grip structure of water sprayer comprises a sprayer body, a grip body is extended downward from one end of the sprayer body, a front surface of the grip body is covered with a front grip fitting portion, a fixing structure is disposed on a back surface of the grip body, a back grip fitting portion is fitted on the back surface of the grip body. The back grip fitting portion has a fitting structure to be fitted and engaged with the fixing structure, so that the back grip fitting portion is fitted on the grip body. Accordingly, the back grip fitting portion of the present invention can be dismounted and replaced at will which is convenient for maintenance and usage.

5 Claims, 5 Drawing Sheets

GRIP STRUCTURE OF WATER SPRAYER

BACKGROUND

1. Field of Invention

The present invention relates to a grip structure of water sprayer and more particularly to a grip body of water sprayer which is made in a form of combination structure; the structure of a back grip fitting portion fitted with the grip body can provide diversified forms of combination for the grip. The back grip fitting portion can be replaced at will in order to enhance the convenience of usage.

2. Related Art

FIG. 5 shows a conventional water sprayer 50 which comprises a sprayer body 51, a grip body 52 is extended downward from the sprayer body 51. The grip body 52 is for gripping by a hand, and it includes a front grip fitting portion 521 and a back grip fitting portion 522. The grip body 52 is covered by the front grip fitting portion 521 and the back grip fitting portion 522 which both of them are formed by plastic injection molding.

When using the water sprayer 50, hold the grip body 52 by hand to spray. When the water sprayer 50 is held, a part of the hand between the thumb and the index finger is placed on the back grip fitting portion 522, and the fingers are placed on the front grip fitting portion 521. In order to spray water, the part of the hand between the thumb and the index finger has to support the back grip fitting portion 522 so as to hold the water sprayer 50 properly.

According to the abovementioned description, friction is produced between the back grip fitting portion 522 and the part of the hand between the thumb and the index finger; therefore the back grip fitting portion 522 will easily be worn out after the water sprayer 50 has been used for a long period. Even though the water sprayer 50 can still be used, it is rather uncomfortable for users. When the back grip fitting portion 522 is worn out to a great degree or the worn out part is enlarged, it will affect gripping of the water sprayer 50 and application of force on it.

The front grip fitting portion 521 and the back grip fitting portion 522 of the grip body 52 are formed by injection molding to cover the water sprayer 50, which cannot be dismounted and replaced at will, therefore the water sprayer 50 is inconvenient for maintenance.

SUMMARY

Aspects of the invention overcome shortfalls of a conventional water sprayer. For example, a conventional water sprayer includes the front grip fitting portion and back grip fitting portion of the grip body that are formed by injection molding. This construction includes one or more of the following disadvantages: Friction is easily produced between the back grip fitting portion and the part of the hand between the thumb and the index finger; therefore the back grip fitting portion will be worn out by the hand after the water sprayer has been used for a long period, thus it is rather uncomfortable for users. The back grip fitting portion of the grip body cannot be dismounted and replaced at will, therefore it is inconvenient for maintenance.

Embodiments of the invention overcome shortfalls of the prior designs by including a sprayer body and a grip body is extended downward from one end of the sprayer body. The grip body includes a front surface of the grip body that is covered by a front grip fitting portion. A fixing structure is disposed on a back surface of the grip body. The back grip fitting portion is fitted on the back surface of the grip body.

The sprayer body includes a back grip fitting portion, and the back grip fitting portion includes a fitting piece. The fitting piece has a fitting structure disposed in corresponding to the fixing structure. The fitting structure can be fitted together with the fixing structure so that the back grip fitting portion is fitted on the grip body.

One end of the grip body is different from an end connected to the sprayer body, which is formed as a fitting portion with a larger diameter; an engaging portion facing the grip body is formed at a bottom end of the fitting piece; a diameter of the engaging portion is larger than that of the fitting portion, so that the fitting portion can be fitted and engaged with the engaging portion. The fixing structure includes a tenon disposing on the grip body and closed to the end which is connected to the sprayer body, the tenon is extended outward from the grip body. The fitting structure includes two protruded pieces, the two protruded pieces are extended outward from the fitting piece toward the fixing structure, and a fixing groove is formed between the two protruded pieces for the tenon to be fitted and engaged inside.

The fixing structure further includes a limiting column, the limiting column is disposed below the tenon and is extended outward from the grip body. The fitting structure includes a fixing column, the fixing column is extended from the fitting piece toward the fixing structure; a concave hole is disposed at an exposed end of the fixing column, and the limiting column is limited by the concave hole.

According to the structures and design mentioned above, the back grip fitting portion of a grip structure of water sprayer according to the present invention can be dismounted and replaced.

Embodiments of the present invention provide a grip structure of water sprayer; the back grip fitting portion of the grip body according to the present invention can be dismounted and replaced which is convenient for maintenance. Aspects of the invention overcome the drawbacks of a conventional water sprayer, and the back grip fitting portion can provide diversified forms of combination according to requirements of users.

The present invention will become more fully understood by reference to the following detailed description thereof when read in conjunction with the attached drawings.

BRIEF DESCRIPTION OF THE DRAWINGS

Corresponding reference characters indicate corresponding parts throughout the drawings.

DETAILED DESCRIPTION

Figure 1:
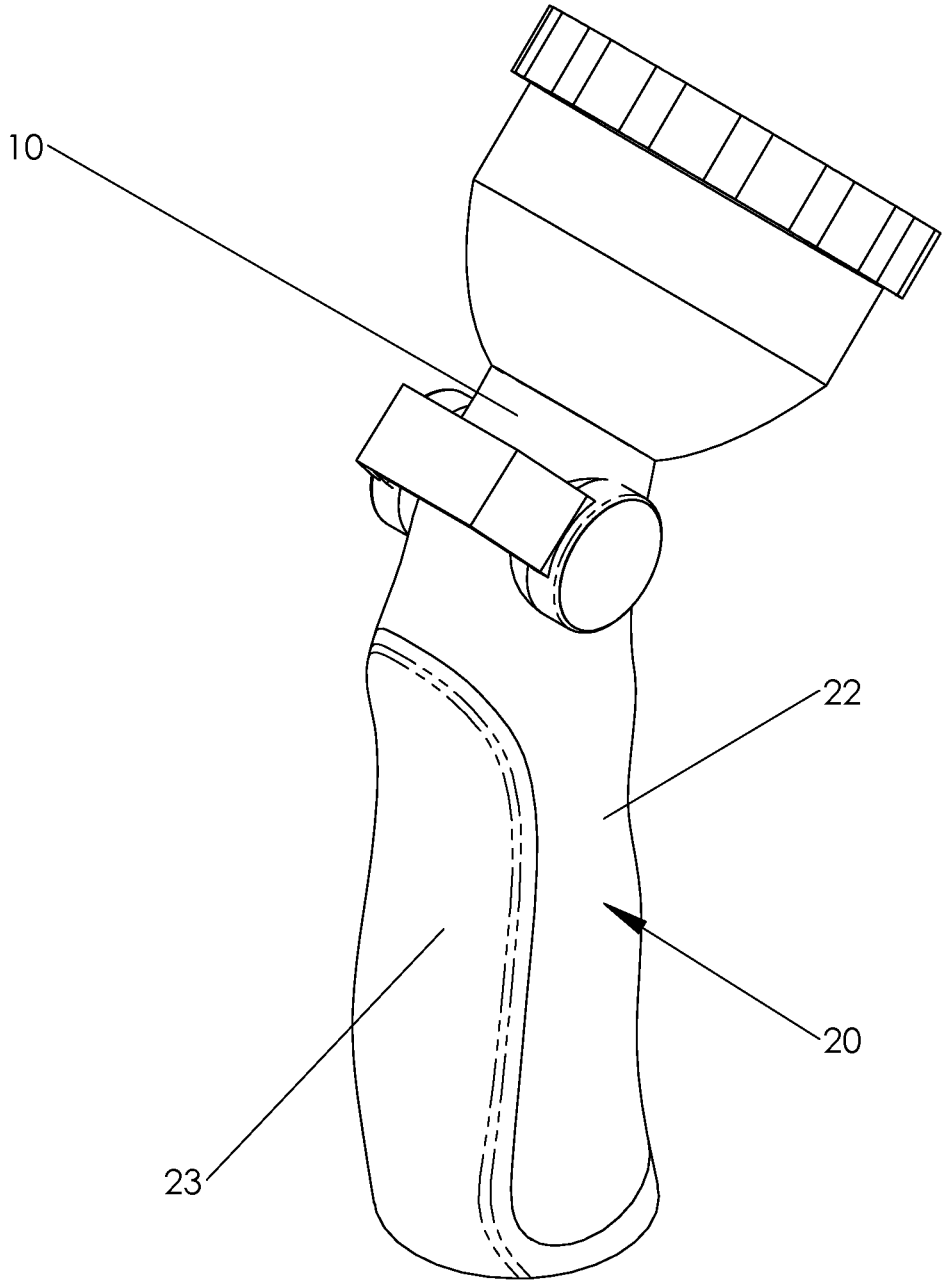
FIG. 1 is perspective view of a grip structure of water sprayer according to one embodiment of the present invention.
Figure 2:
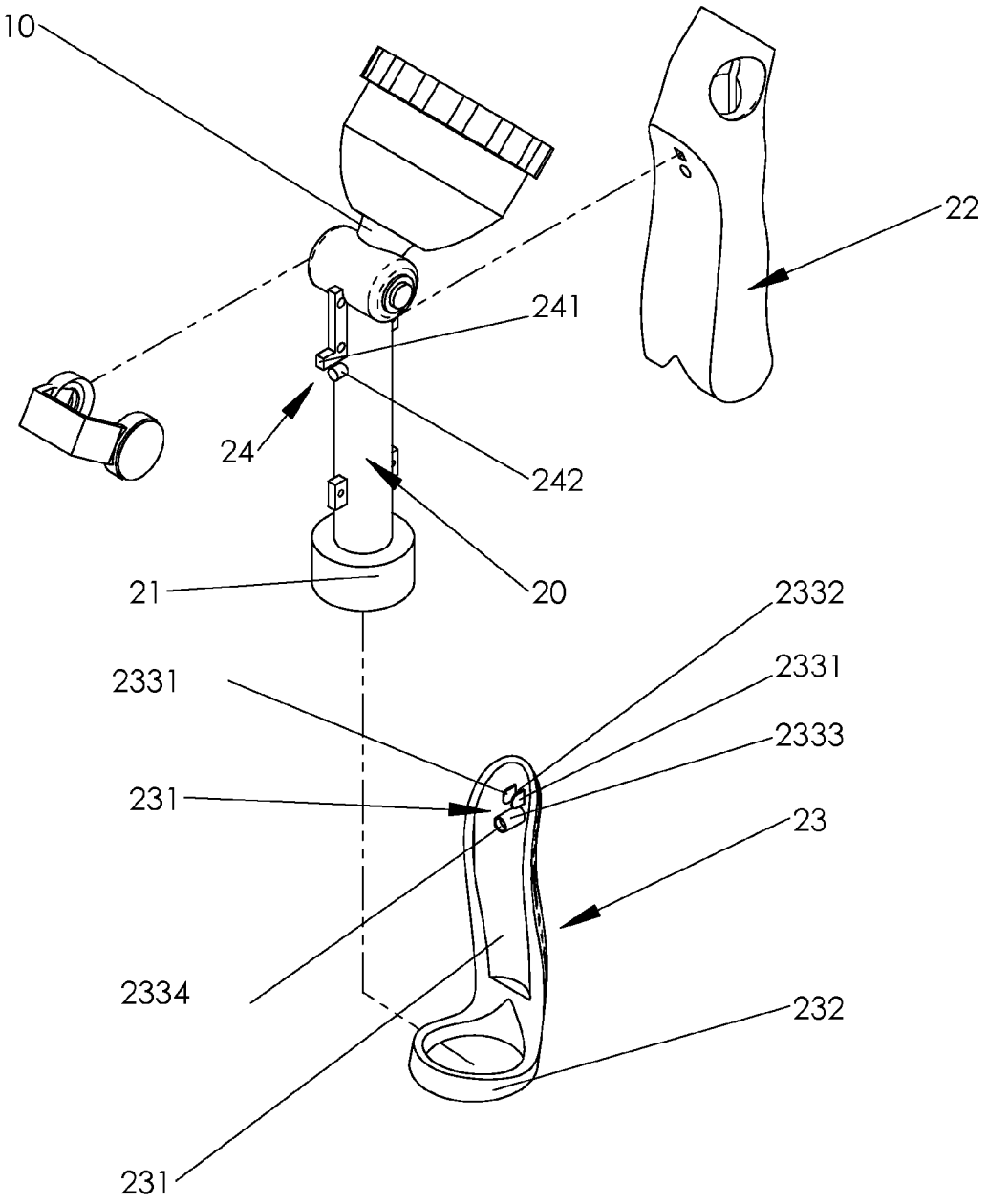
FIG. 2 is an exploded perspective view of a grip structure of water sprayer according to one embodiment of the present invention.
Figure 3:
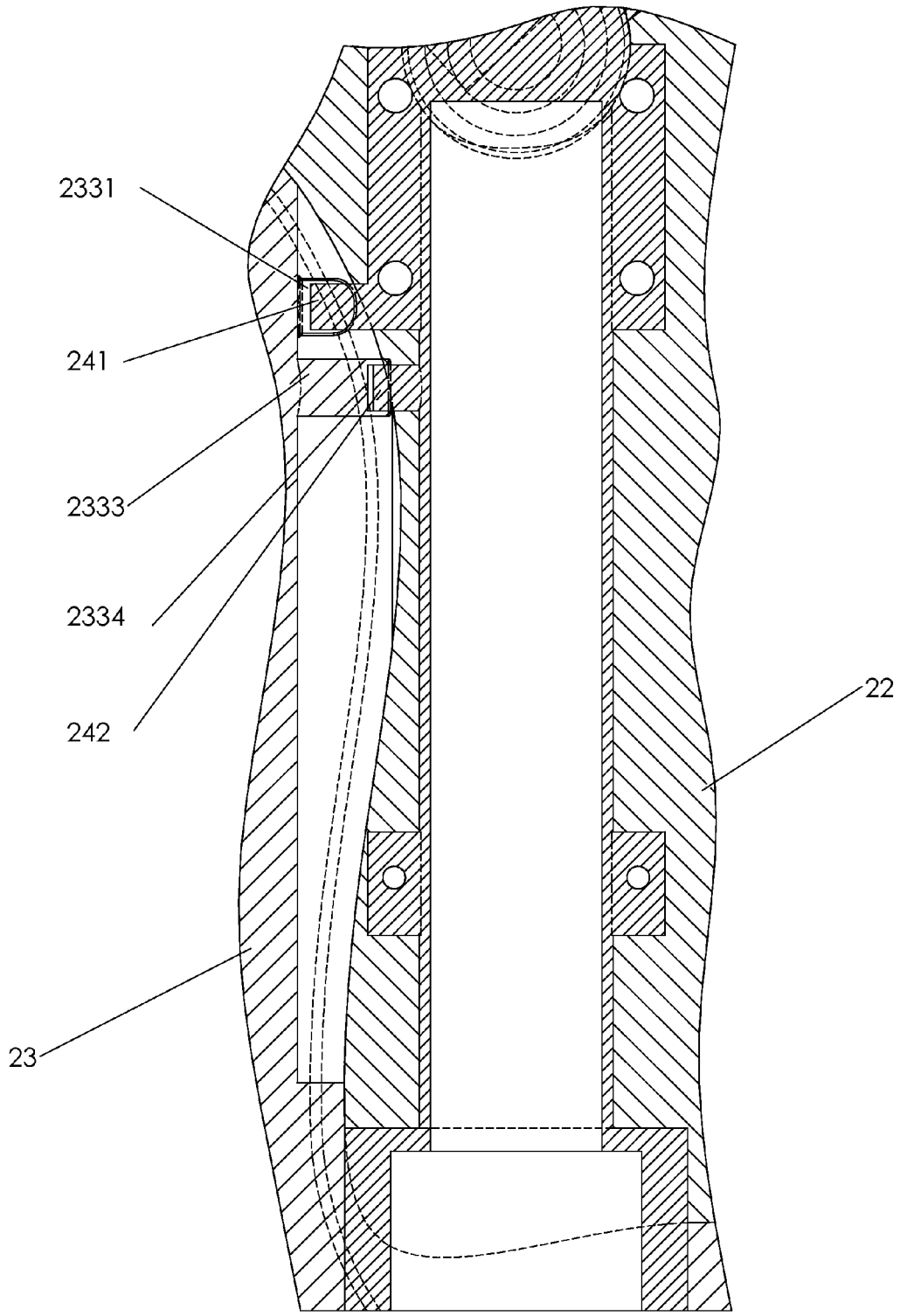
FIG. 3 is a cross-sectional view of a grip structure of water sprayer according to one embodiment of the present invention.

Referring to FIGS. 1 to 3. The present invention provides a grip structure of water sprayer which comprises a sprayer body 10, a grip body 20 extended downward from one end of the sprayer body 10. One end of the grip body is different from an end connected to the sprayer body, which is formed as a fitting portion 21 with a larger diameter. A front surface of the grip body 20 is covered by a front grip fitting portion 22, and a back grip fitting portion 23 is fitted and engaged on a back surface of the grip body. The back grip fitting portion 23 can be made of metal.

A fixing structure 24 is disposed on the back surface of the grip body 20, the back grip fitting portion 23 includes a fitting piece 231, an engaging portion 232 facing the grip body 20 is formed at a bottom end of the fitting piece 231; a diameter of the engaging portion 232 is larger than that of the fitting portion 21, so that the fitting portion 21 can be fitted and engaged with the engaging portion 232. The fitting piece 231 has a fitting structure 233 disposed in corresponding to the fixing structure 24, the fitting structure 233 can be fitted together with the fixing structure 24, so that the back grip fitting portion 23 is fitted on the grip body 20.

The fixing structure 24 includes a tenon 241 disposing on the grip body 20 and closed to the end which is connected to the sprayer body 10, the tenon 241 is extended outward from the grip body 20. The fixing structure 24 further includes a limiting column 242, the limiting column 242 is disposed below the tenon 241 and is extended outward from the grip body 20.

The fitting structure 233 includes two protruded pieces 2331, the two protruded pieces 2331 are extended outward from the fitting piece 231 toward the fixing structure 24, and a fixing groove 2332 is formed between the two protruded pieces 2331 for the tenon 241 to be fitted and engaged inside. The fitting structure 233 further includes a fixing column 2333, the fixing column 2333 is extended from the fitting piece 231 toward the fixing structure 24; a concave hole 2334 is disposed at an exposed end of the fixing column 2333, and the limiting column 242 is limited by the concave hole 2334.

Figure 4:
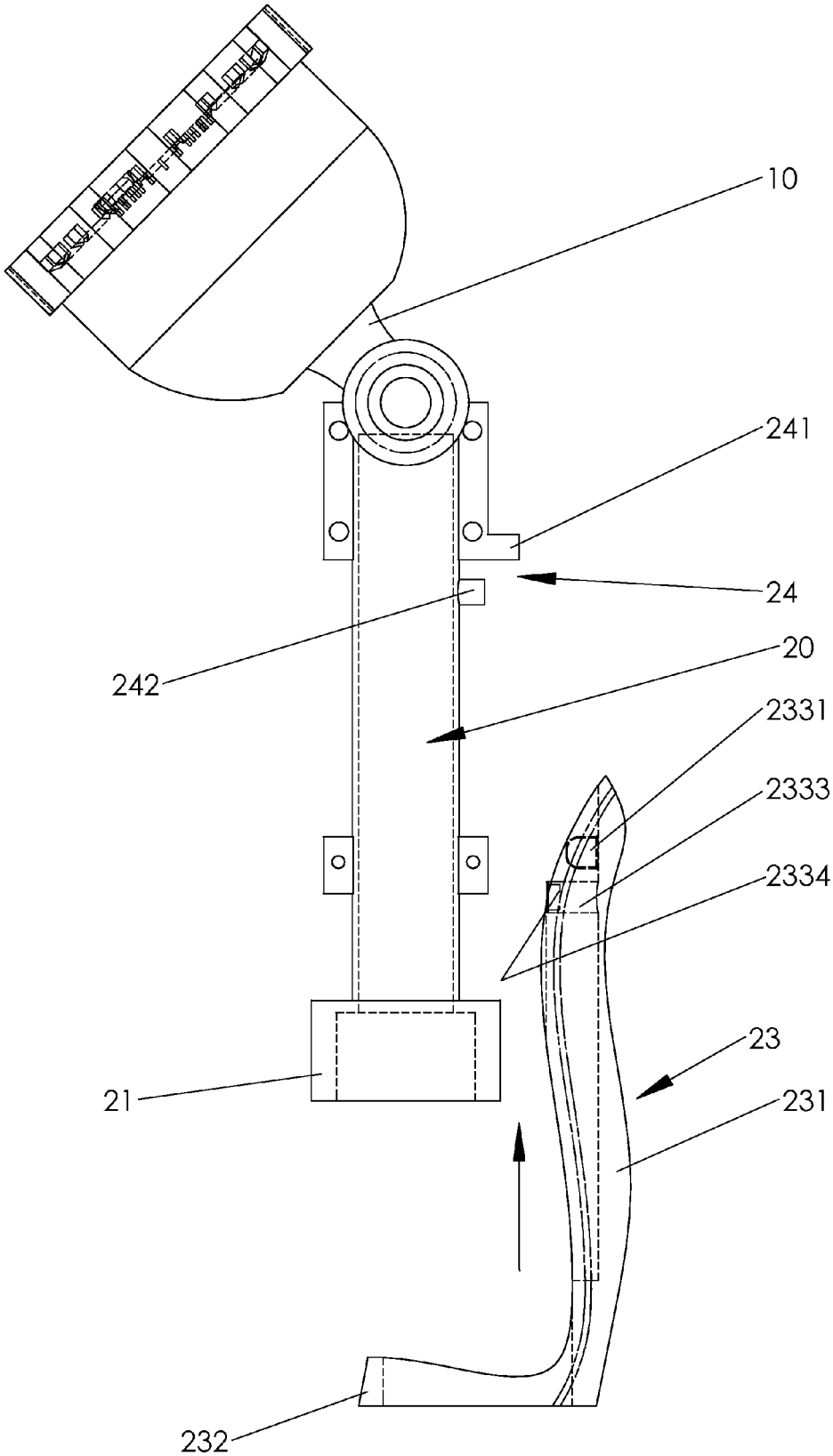
FIG. 4 is an assembling view of a grip structure of water sprayer according to one embodiment of the present invention.
Figure 5:
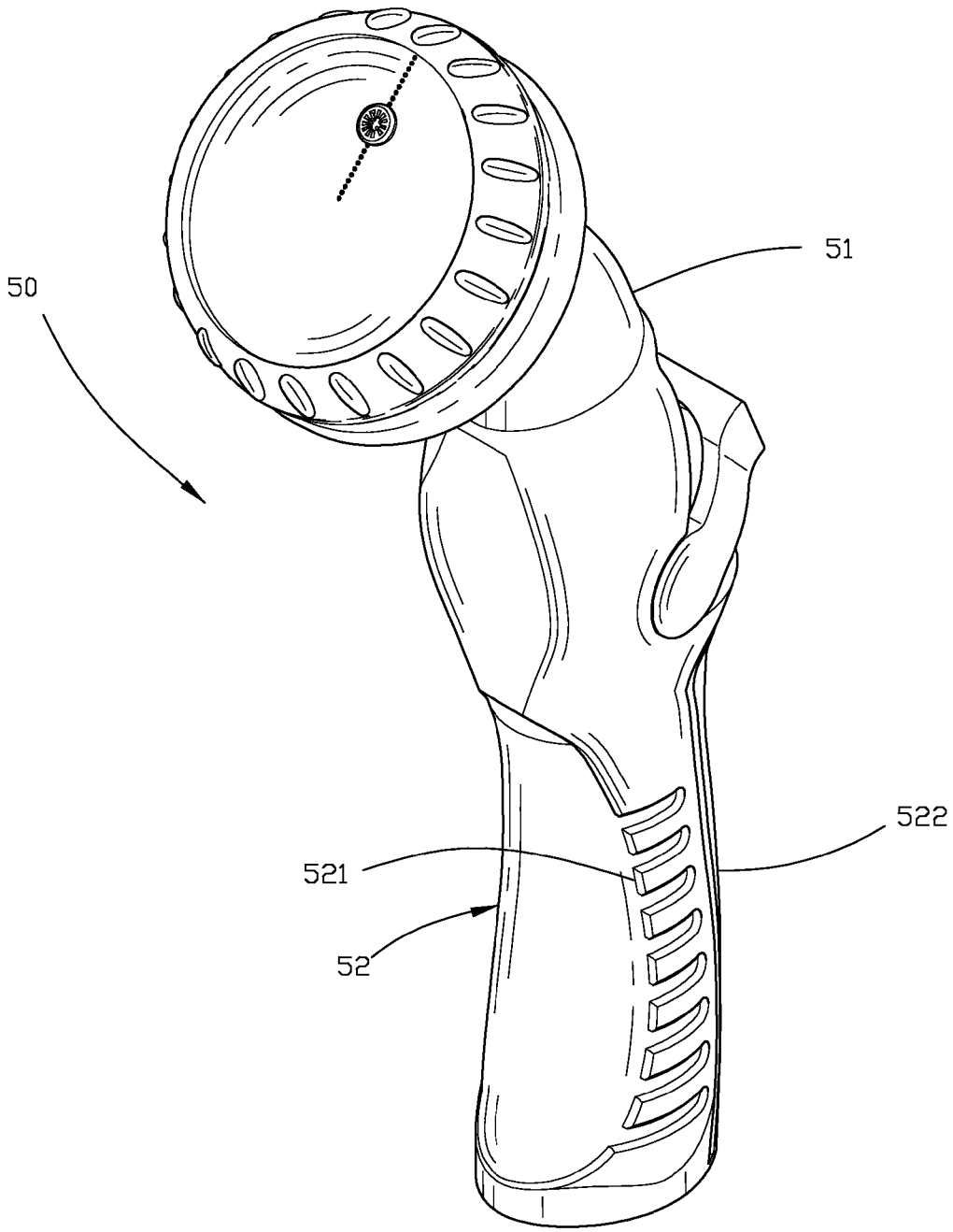
FIG. 5 is a perspective view of a water sprayer of a prior art.

For the assembling of the present invention, please base on the above structures and design and refer to FIG. 4. The back grip fitting portion 23 is fitted and engaged with the grip body 20 from its bottom and work upward; the engaging portion 232 of the fitting piece 231 will be fitted and engaged with the fitting portion 21; the tenon 241 of the fixing structure 24 will be fitted and engaged inside the fixing groove 2332 of the fitting structure 233, and the limiting column 242 of the fixing structure 24 will be fitted inside the concave hole 2334 of the fitting structure 233; so that the grip body 20 is covered by the fitting piece 231, and the fitting piece 231 is combined with the front grip fitting portion 22; a grip structure of water sprayer of the present invention is therefore formed and assembled.

When the water sprayer is held, a part of the hand between the thumb and the index finger is placed on the back grip fitting portion, and the back grip fitting portion is not easily worn out because it is made of metal. It can be dismounted and replaced even if it is broken or damaged. Therefore, the water sprayer of the present invention is convenient for maintenance and convenient to use after replacement. Furthermore, the back grip fitting portion can be in any color as required by users, so that a grip structure of water sprayer of the present invention can provide diversified colors.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A grip structure of a water sprayer, comprising:

a sprayer body;

a grip body is extended downward from one end of the sprayer body, said grip body having a back surface;

a front surface of the grip body is covered by a front grip fitting portion;

a fixing structure being disposed on the back surface of the grip body;

a back grip fitting portion being fitted on the back surface of the grip body, said back grip fitting portion including a fitting piece, said fitting piece having a fitting structure disposed in corresponding to the fixing structure, the fitting structure can be fitted and engaged together with the fixing structure so that the back grip fitting portion is fitted on the grip body, and an engaging portion facing the grip body, said engaging portion being formed at a bottom end of the fitting piece, wherein said engaging portion having a diameter that is larger than that of the fitting portion so that the fitting portion is fitted and engaged with the engaging portion, wherein the fixing structure comprises a tenon disposing on the grip body and closed to the end for connecting to the sprayer body, said tenon being extended outward from the grip body, wherein the fitting structure includes two protruded pieces, said two protruded pieces being extended outward from the fitting piece toward the fixing structure, and a fixing groove is formed between the two protruded pieces for the tenon to be fitted and engaged therein.

2. The grip structure of the water sprayer as claimed in claim 1, wherein one end of the grip body is different from an end connected to the sprayer body, said end of the grip body being formed as a fitting portion with a larger diameter.

3. The grip structure of the water sprayer as claimed in claim 2, wherein the fixing structure further comprises a limiting column, the limiting column being disposed below the tenon and being extended outward from the grip body, wherein the fitting structure includes a fixing column, said fixing column being extended from the fitting piece toward the fixing structure.

4. The grip structure of the water sprayer as claimed in claim 3, wherein the fixing column comprises an exposed end having a concave hole is disposed thereat, and wherein the limiting column is limited by the concave hole.

5. The grip structure of the water sprayer as claimed in claim 1, wherein the back grip fitting portion is made of metal.

* * * * *